US005530998A

United States Patent [19]

Hurst et al.

[11] Patent Number: 5,530,998

[45] Date of Patent: Jul. 2, 1996

[54] TWIST AND SNAP FASTENER MADE OF IDENTICAL MATING PARTS

[76] Inventors: Carl P. Hurst, 1419 Tangier Way, Sarasota, Fla. 34239; Monica Hujazi, 1016 San Raymundo Rd., Hillsborough, Calif. 94010

[21] Appl. No.: 292,325

[22] Filed: Oct. 12, 1994

[51] Int. Cl.[6] ..... A44B 21/00

[52] U.S. Cl. ..... 24/575; 24/590; 24/591

[58] Field of Search ..... 24/575, 576, 578, 24/590, 591, 594, 595, 615, 98, 114.2, 114.12; 411/554; 70/456

[56] References Cited

U.S. PATENT DOCUMENTS

| | | | |
|---|---|---|---|
| 410,304 | 9/1889 | Watters | 24/591 |
| 1,095,794 | 5/1914 | Braecklein | 24/575 |
| 1,270,141 | 6/1918 | Fuller | 24/590 |
| 1,493,365 | 5/1924 | Meas | 24/590 |
| 2,867,025 | 1/1959 | Aler | 24/575 |
| 3,520,033 | 7/1970 | Genji Usuda | 24/575 |
| 3,699,617 | 10/1972 | Hofmeister | 24/575 |
| 5,261,257 | 11/1993 | Collier | 24/575 |

FOREIGN PATENT DOCUMENTS

| | | | |
|---|---|---|---|
| 0700267 | 11/1953 | United Kingdom | 24/575 |

*Primary Examiner*—Victor N. Sakran

[57] ABSTRACT

This invention is a fastener designed for simplicity, ease of use, and economy of manufacture and implementation. It can replace all buttons in the garment industry, and negate the need for sewing and stiching button holes. It is durable and simple. For emergency use, it offers the ease of rip open disengagement. Foreseeable uses include packages containing life vests, emergency tools, medicine, and weapons. For sailing it can be used in racing situations where covered sails are needed immediately for sail changes. For camping, tent flaps are swiftly fastened or unfastened. In all cases this fastener can be used while wearing even thick gloves. Due to very simple and economical manufacture, in hospitals such fasteners require no tying or buttoning while wearing gloves, and as the material is very tough, these fasteners will withstand repeated hot water, detergents, salt water, and driers. For socks, they can be snapped to sock tops to match them prior to washing. For rougher applications at sea, the fasteners can be stamped out of stainless or brass and crimped like snaps onto canvas and other rugged materials.

3 Claims, 2 Drawing Sheets

TWIST AND SNAP FASTENER MADE OF IDENTICAL MATING PARTS

BRIEF SUMMARY OF THE INVENTION

This is a fastener made of identical interlocking parts intended for use as a material or strap fastener. When parts are placed face to face and twisted, they interlock. The parts consist either of molded plastic or stamped metal.

BRIEF DESCRIPTIONS OF THE VIEWS OF THE DRAWINGS

FIG. 1A depicts the working part of the fastener. The upper views are of the face of one of the mating surfaces or locking plate. One view is frontal, the other is a side, edge view. The edge view shows the mushroom protrusion, while the frontal view shows the "keyhole" opening, into which the mating locking plate's mushroom would pass, turn and engage. This occurs in both mating parts simultaneously. The drawing is representative of a single mushroom-keyhole arrangement, but the application is for any number of matching pairs of mushrooms and keyholes for this fastener. FIG. 1B depicts the matching attachment ring, into which the molded needles from the fastener parts would pass. The ring has a number of holes matching the size and number of the needles on the fastener back. More needles and ting-holes mean more strength.

FIG. 2A depicts how the twisting fastener's locking plate would look when fashioned of metal, say brass, bronze, steel or stainless steel. Again, the top views are of the front and edge on. In this case the fiat metal is stamped, and the cut "tabs" are bent in such a way as to form a ramp on the one side, and a clip (much like a fountain pen clip) on the other. Facing locking plates will then interlock with one another, and twisting them will interlock the mating ramps and clips. Again this drawing is representative of single clip and ramp faces, but this application is for any number of matching ramps and clips that could be stamped into the circle. The teeth around the edge that are formed by the stamped cut out of the fastener are designed to be bent ninety degrees when the fastener is to be attached to material. Longer theeth for thicker material. When they are pushed through the material, they will go through the matching slots in the keeper or backing ring (see FIG. 2B) on the back of the material, where the teeth will be bent outward and flush against the material.

FIG. 2B shows the ring with its matching slots for the teeth shown in FIG. 2A.

DETAILED DESCRIPTION

This device consists of two exactly identical mating parts held to material by integral teeth or needles passing through the material. Both the locking plate and the attachment backing ring are made of the same material. Either both are made of nylon or high impact ABS plastic by injection molding, or they are stamped out of metal. They can be made in any size. Each piece has a receiving slot, and a snap protrusion. When turned face to face, each slot and protrusion has a counterpartprotrusion and slot. To engage the fasteners, they are held face to face, 90 degees out of line. With slight pressure and twisting torque, the protrusions slide into their respective slots. Continued torque results in an audible snap. Now the mating surfaces are flush, and the mutual clips and ramps are engaged. To disengage the parts, the process above is simply reversed. These can be manufactured to engage either clockwise, or counterclockwise, depending on preference or intended use. It those cases where emergency use is intended, where rapid access is desired, the fasteners are attached to a fabric in a row, oriented in the same direction. When access is required, simply pulling the materials in opposite directions from the correct end of the row will deliver the necessary torque, and the fasteners will unsnap and disengage from one another.

Figure 1:
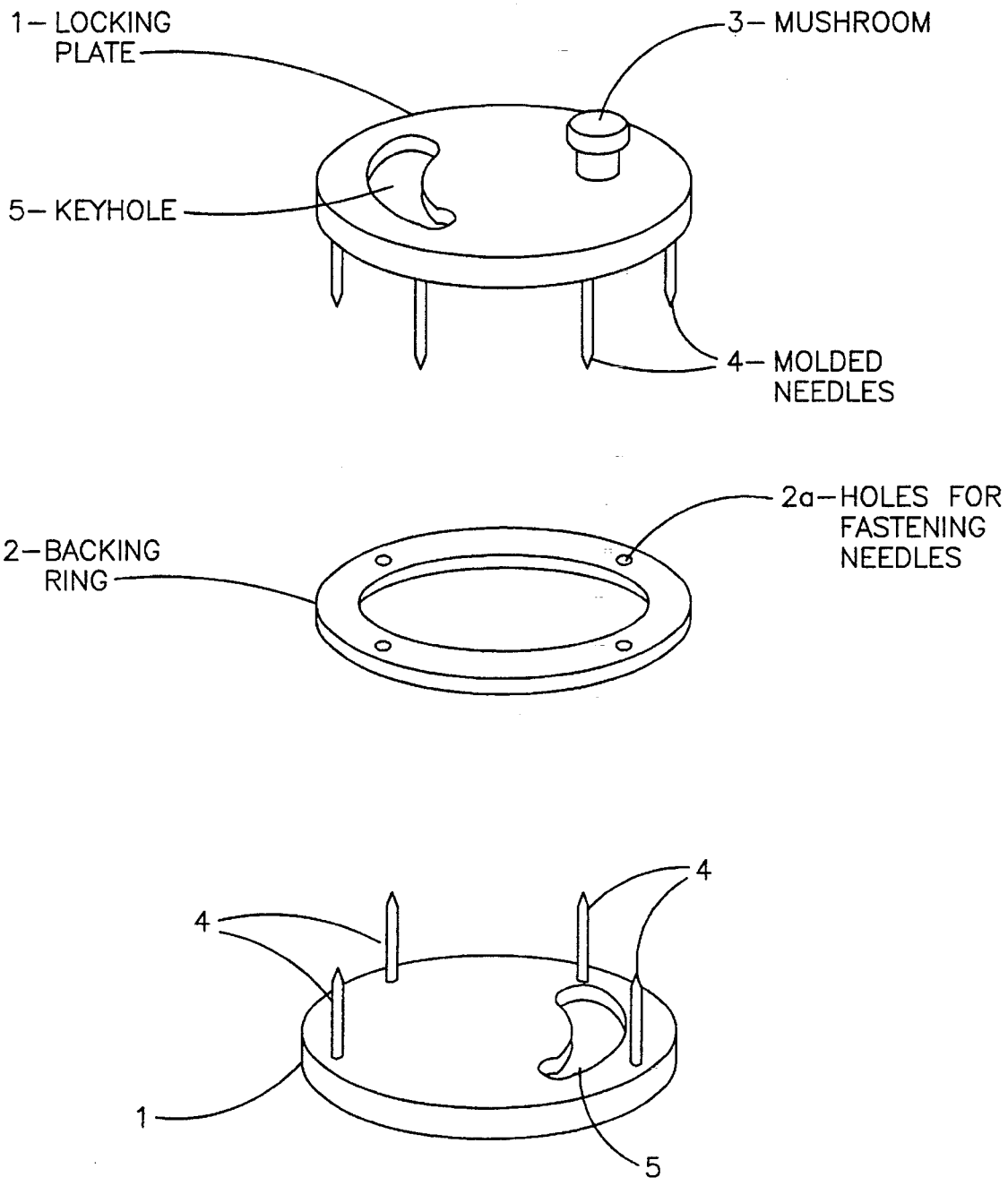

To use as a material fastener, in the case of plastic or nylon, molded pins or needles on the back of the locking plate are passed through the material, and through a mating backing ring of either the same material, or for aesthetics, through a classical looking button. These pins are then melted down to the backing or button to hold both the button and fastener in place. Please refer to FIG. 1 with the descriptive paragraph on the same sheet. Please note the descriptors with arrows.

Figure 2:
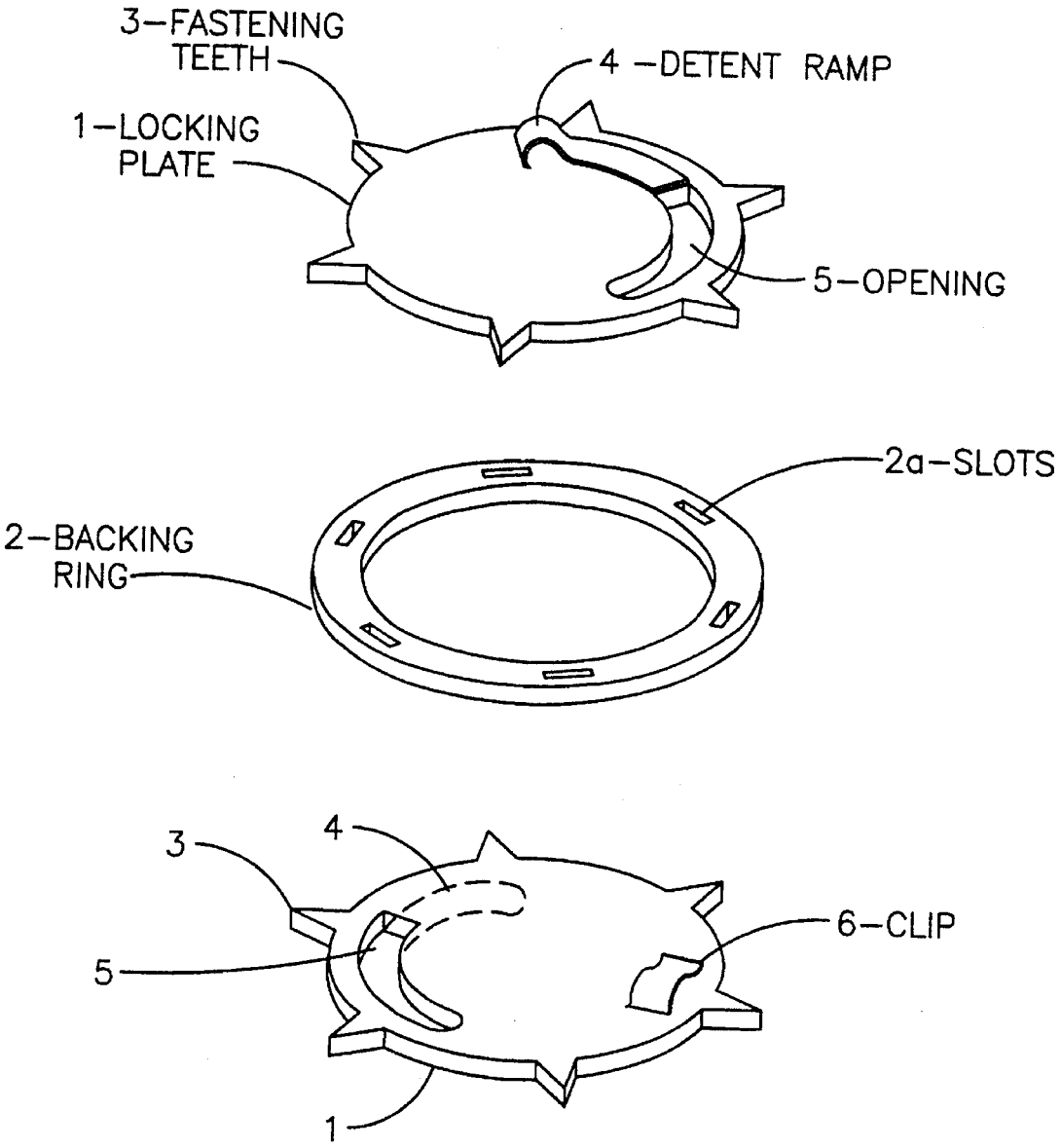

In the case of a metal fastener, which is implemented the same way as the plastic/nylon example above, the stamped mating parts have sharp teeth around the edges that will mate with the holes in a counterpart backing ring. Please refer to FIG. 2 with the description on the same sheet. Please note the descriptors with arrows.

We claim:

1. A quarter turn fastener for articles of clothing and other materials, consisting of two identical parts designed to be attached to the facing surfaces of said materials to be mutually fastened and unfastened, each part comprising an integral combination: a disk of injection molded hard plastic, nylon, resin or other synthetic material, having a face and back, the face having a keyhole shaped slot curving near and parallel to the circumference of the disk and a headed projection at a point 180 degrees and equidistant from the center of the disk as the circular hole end of the keyhole slot, such slot and projection matching an identical slot and keyhole in the other half for fastening, each hole at the end of the slot designed to capture and hold firmly the mating headed projection when the two halves are brought together face to face, mated and manually rotated in opposite directions until positive engagement at the end of rotation occurs, with each disk half having a plurality of needles protruding outward from said back of said disk to be fastened to the fiat surface of said material.

2. The fastener as claimed in claim 1 in which the disks are fashioned from sheet metal, stamped such that tabs bent away from the plane of the disk form a ramp on one side of the disk where the keyhole shaped slot was, and an opposite tab is bent away to form a spring-catch using inherent spring tension in the metal that protrudes from the other side, each half being identical and each hole/ramp being adapted to allow the opposing spring catch to protrude through its mating hole and which, when both disks are rotated in opposite directions cases each spring-catch to ride up its mating ramp and to snap down with a lip behind the ramp's highest point, thereby making a positively locked fastener.

3. The fastener as claimed in claim 2 in which each of the fastener halves are adapted such that the edge of each disk flanges away from its mating half, thereby allowing the projections and ramps to be engaged in a recessed space within each disk's own volume.

* * * * *